United States Patent [19]

Hinz et al.

[11] 4,233,385

[45] Nov. 11, 1980

[54] METHOD AND APPARATUS FOR LIQUID ELECTROSTATIC DEVELOPMENT OF CHARGE IMAGES ON A TAPE-LIKE RECORD CARRIER

[75] Inventors: Hans-Dieter Hinz, Tornesch; Ulf Rothgordt, Norderstedt; Franz Schinke, Hamburg, all of Fed. Rep. of Germany

[73] Assignee: U.S. Philips Corporation, New York, N.Y.

[21] Appl. No.: 824,502

[22] Filed: Aug. 15, 1977

[30] Foreign Application Priority Data

Sep. 11, 1976 [DE] Fed. Rep. of Germany ..... 2641026

[51] Int. Cl.[2] ..... G03G 103/10

[52] U.S. Cl. ..... 430/117; 118/659; 118/660; 118/314; 354/317

[58] Field of Search ..... 96/1 LY; 427/15, 17; 118/637, DIG. 23, 659, 660, 325, 314, 315, 316; 354/317

[56] References Cited

U.S. PATENT DOCUMENTS

| | | | |
|---|---|---|---|
| 3,169,887 | 2/1965 | York | 118/DIG. 23 |
| 3,336,906 | 8/1967 | Michalchik | 427/15 |
| 3,369,918 | 2/1968 | Young | 427/17 |
| 3,577,259 | 5/1971 | Sato et al. | 118/DIG. 23 |
| 3,642,515 | 2/1972 | Sato et al. | 427/17 |
| 3,799,791 | 3/1974 | Kolibas | 96/1LY |

FOREIGN PATENT DOCUMENTS

| | | | |
|---|---|---|---|
| 1333421 | 10/1973 | United Kingdom | 118/315 |

*Primary Examiner*—Roland E. Martin, Jr.
*Assistant Examiner*—John L. Goodrow
*Attorney, Agent, or Firm*—David R. Treacy

[57] ABSTRACT

A method of liquid development of charge images formed on a surface of a tape-like record carrier, for example by an electrostatic printer. The record carrier is simultaneously sprayed with developer liquid in two flows which are directed towards each other. As a result, two separate, uniform and oppositely directed flow zones meeting at one common turbulent flow zone are obtained. Both during pre-development and final developement the charge images are brought into contact with a large quantity of fresh developer liquid.

3 Claims, 1 Drawing Figure

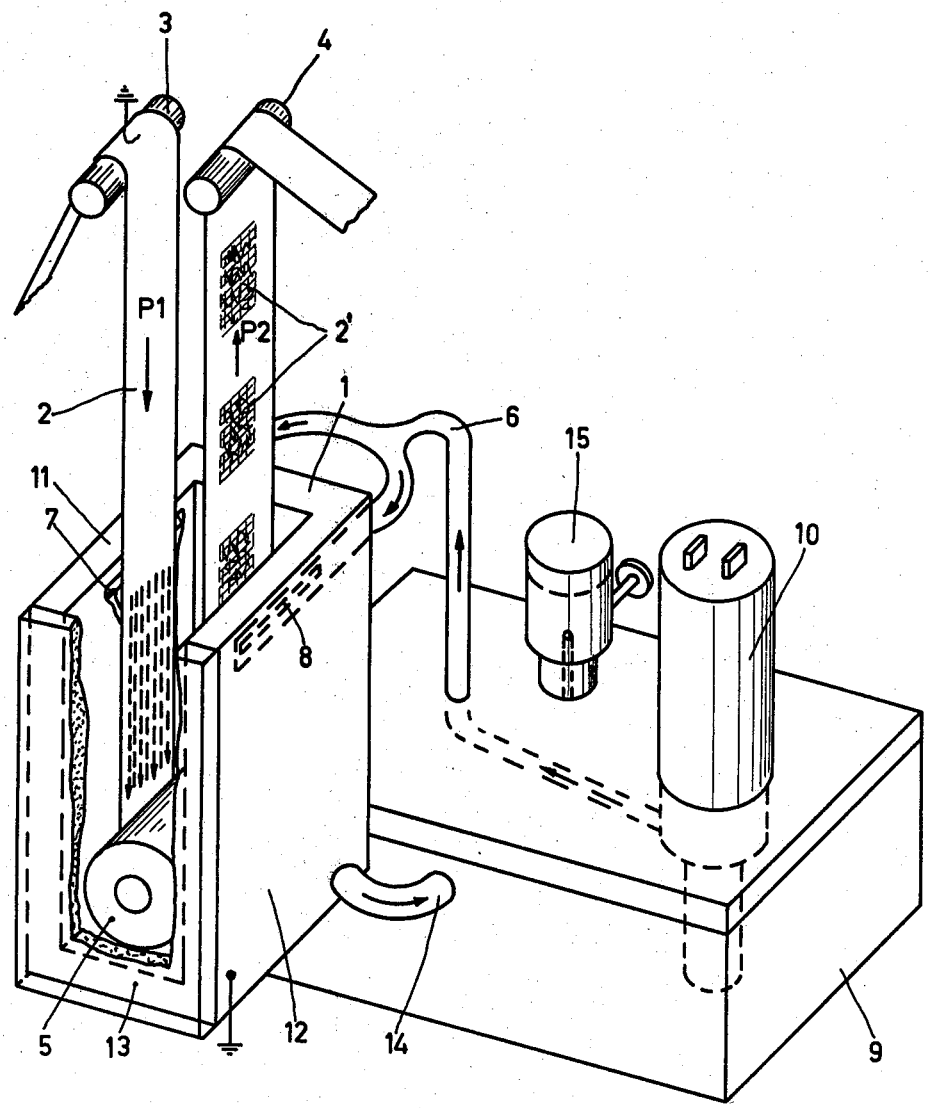
3
4
P1
P2
2'
2
1
6
15
11
7
10
8
5
13
12
14
9

METHOD AND APPARATUS FOR LIQUID ELECTROSTATIC DEVELOPMENT OF CHARGE IMAGES ON A TAPE-LIKE RECORD CARRIER

BACKGROUND OF THE INVENTION

The invention relates to a method of and a device for electrostatic development of charge images on a smooth, tape-like record carrier in a liquid, by guiding the record carrier through a developer tank through which developer liquid continuously flows.

In the electrophotographic copying technique, liquid developer systems are known in which a sheet provided with electrostatic charge images is either immersed in a tank containing the liquid developer, or is supplied to rollers which spread the developer over the sheet. In the former case, either the sheet or the liquid developer must continuously remain in motion, so that the liquid slides up and down the charged side of the sheet.

It is also known (German Auslegeschrift No. 22 31 327) to pump the liquid developer from a reservoir upwards into a developer tank, so that the developer can emerge from a slot provided in the bottom of the tank. Thus, the sheet to be developed is wetted from below by the liquid which is present in the tank. When the bottom of the holder is arranged to be inclined, the developer slowly flows along the surface of the sheet and is subsequently returned to the reservoir.

This known method of development, however, is not suitable for tape-like record carriers which have a smooth surface and which are used in electrostatic printers, for example, as described in German Offenlegungsschrift No. 24 18 632 to which U.S. Pat. No. 4,028,711 corresponds. The charge images are not completely developed when the tape-like record carrier, preferably made of polyester, is simply immersed in or pulled through a developer tank. This is because the shearing forces in the developer are not sufficient to ensure that the interface layer adhering to the tape-like record carrier is sufficiently thin. Thus, only the toner particles present in the interface layer can be deposited on the electrostatically charge surfaces of the record carrier, so that fresh developer required for complete development is blocked by the laminar interface layer.

SUMMARY OF THE INVENTION

The object of the invention is to provide a method and a device enabling high-resolution development, with suitable density, of electrostatic micro-images for text printing as well as uniform, finely graduated half-tone development for facsimile printing on smooth, tape-like record carriers, damaging of the vulnerable micro-images being avoided.

To this end, in accordance with the invention the developer liquid in the developer tank is simultaneously sprayed in two flows, directed towards each other, against the side of the record carrier provided with the charge images, so that two separate, uniform flow zones and one common turbulent flow zone of the developer liquid are obtained on the surface of the record carrier. Preferably, the developer liquid is sprayed against the record carrier under pressure. The transport mode of the record carrier is not important in this respect. The record carrier may be continuously or intermittently pulled through the developer tank. It is only important that the turbulent zone reaches all regions of the record carrier provided with electrostatic charge images.

A general advantage of this method of development of electrostatic micro-images, impressed on the surface of a smooth polyester foil in the form of very small charge dot patterns, is that the charge images are forced into intimate contact with a large quantity of liquid developer, fresh quantities of developer which are not yet low in toner being brought into the direct vicinity of the charge images. This process is more intense if one of the two flows is directed in the transport direction of the record carrier, while the other flow opposes the direction of transport. The second flow against the direction of transport ensures optimum complete development of the micro-images developed to a high degree by the first flow in the transport direction, the field forces then attracting the toner liquid already being small because in the opposite flow fresh developer is supplied from the location where development must have been completed. In the region where the two flows meet, a turbulent flow zone arises, which further stimulates final development.

In apparatus in accordance with the invention means for guiding the record carrier vertically into and out of the developer tank from one side, and for deflecting the record carrier in the tank itself are provided. The side walls of the developer tank have horizontal slots opposite the electro-statically charged surfaces of the record carrier, these slots communicating with a reservoir for the developer liquid and being directed obliquely downwards towards the interior of the developer tank. These slots are preferably provided in the vicinity of the entrance and exit opening for the record carrier. The developer liquid is supplied to these slots from the reservoir by means of a pump. The spent developer liquid is returned to the reservoir from the bottom of the developer tank.

Thus, in the inventive apparatus the two developer flows flow, while developing in the opposite direction, downwards along the image-carrying surface of the record carrier by gravity, until they meet underneath the deflection roller. The excess developer then flows back to the reservoir. For optimum deposition of the charged toner of the dispersion developer liquid on the charge images by an electrophoretic process, the side walls of the developer tank, being constructed as developer electrodes, are arranged very near to the image-carrying sides of the record carrier, and are electrically conductively connected to the metallized back of the record carrier.

The simultaneous development of the charge images on two faces offers the advantage that both downwards flowing developer flows, deteriorated in the active interface layer due to the decrease of toner, meet underneath the deflection roller where they detach each other from the record carrier and drip off. The deteriorated developer liquid films, therefore, need not be removed by special devices, for example, by wringers. Thus, damaging of the finely structured micro-images on the smooth surface of the record carrier is precluded.

An apparatus in accordance with the invention will be described in detail hereinafter with reference to the accompanying diagrammatic drawing.

DESCRIPTION OF THE PREFERRED EMBODIMENT

The apparatus in accordance with the invention comprises a developer tank 1 which is open at its top. The record carrier 2 is vertically introduced into this tank in the direction of the arrow P1 and, after deflection in the vicinity of the bottom of the tank by the deflection roller 5, the record carrier is vertically discharged from the developer tank 1 upwardly as shown by the arrow P2. Guiding at the top of each vertical run may be performed, for example, by two fixed guide rollers 3 and 4. The record carrier 2 is conducted through the developer tank 1 so that the side surface of the record carrier 2 which is provided with charge images 2' faces the side walls 11, 12, respectively, of the tank. In order to enable the development process inside the developer tank 1 to be observed, the front wall 13 (shown partly broken away in the figure) may be transparent. If this front is also constructed to be detachable, the record carrier 2 can be easily guided around the deflection roller 5.

Horizontal slots 7 and 8 are provided in the side walls 11 and 12 near the top opening of the tank 1, said connected to a supply duct 6 for the developer liquid. These slots 7 and 8 are shaped so that the developer liquid is readily sprayed downwards at an angle against the electrostatically printed smooth side of the record carrier 2. Thus, the developer liquid uniformly flows down on the record carrier 2. This process is denoted by a few long, broken arrows. The two flow directions oppose each other across the surface of the record carrier. One direction coincides with the direction of movement, while the other direction opposes the direction of movement. From a reservoir 9, containing the supply of liquid, the developer liquid is supplied to the spraying slots 7 and 8 by an electric gear pump 10, through the supply duct 6 which is split into two subducts at a shot distance before the developer tank 1. The slot shape and the slot dimensions cause laminar discharging of the developer liquid at the necessary supply rate.

After uniform flowing of the developer liquid over the zones, the two flow directions meet below the deflection roller 5 where they form a common turbulent flow zone. Because the two flows detach each other, the developer liquid is removed from the record carrier 2 in this region and is returned to the reservoir 9 through a discharge duct 14.

This development process involves three development phases. First, in the transport direction P1 of the record carrier 2 pre-development takes place by the uniform flow of developer liquid, this pre-development being followed by further development in the region of the turbulent flow zone. Final development is then effected by the developer liquid which flows against the movement direction P2 of the record carrier 2. Optimum final development is ensured in that the regions of the record carrier 2 which have already been developed to a high degree are brought into contact with developer liquid which is rich in toner.

A supply chamber 15 containing a supply of toner concentrate is connected to the reservoir to replenish toner, automatically or manually, during the development. Moreover, for optimum deposition of the charge toner particles on the charge images of the record carrier 2 by an electrophoretic process, the side walls 11 and 12 of the developer tank 1 are constructed as developing electrodes which are electrically conductive and have an electrically conductive connection to the metallized back of the record carrier 2. Symbolically denoted in the drawing by the earth symbols.

The input and output device for the record carrier 2 need not be exactly vertical. It is only important that the developer liquid sprayed against the record carrier 2 by the sprayer slots 7 and 8 uniformly flows over the record carrier and does not drip from the record carrier 2, due to gravity, before the turbulent flow zone below the deflection roller 5 is reached.

What is claimed is:

1. A method of electrostatic development of electrostatic charge images impressed on a surface of a smooth, tape-like record carrier in a liquid, by guiding the carrier through a developer tank through which developer liquid is continuously flowing, comprising:

spraying a first flow of developer liquid against the surface of the record carrier on which the charge image is formed so as to form a first uniform flow zone, spraying a second flow of developer liquid against the surface of the record carrier on which the charge image is formed so as to form a second uniform flow zone, the liquid in said first and second flows flowing toward each other on said surface, and the liquid in said first and second flow zones flowing on said surface to a common turbulent flow zone at the meeting of the two uniform flow zones.

2. A method as claimed in claim 1 wherein said first flow spraying causes developer flow in said first flow zone in the direction of carrier movement, and said second flow spraying step causes developer flow in said second zone opposite to the direction of carrier movement.

3. A method as claimed in claim 2 wherein said common turbulent zone is near the bottom of the developer tank, and in said first and second zones the carrier is moved in opposite generally vertical directions.

* * * * *